United States Patent [19]

Schambeck et al.

[11] Patent Number: 4,610,117

[45] Date of Patent: Sep. 9, 1986

[54] MULTIPLE-SPAN BRIDGE SUPPORT SYSTEM FOR VEHICLES WITH HIGH BRAKING FORCES

[75] Inventors: Herbert Schambeck, Frieding/Andechs; Dieter Hilliges, Neuried; Hans Foerst, Ascheim, all of Fed. Rep. of Germany

[73] Assignee: Dyckerhoff & Widmann Aktiengesllschaft, Munich, Fed. Rep. of Germany

[21] Appl. No.: 770,152

[22] Filed: Aug. 27, 1985

[30] Foreign Application Priority Data

Aug. 31, 1984 [DE] Fed. Rep. of Germany ..... 3432166

[51] Int. Cl.[4] ..... E04C 3/10

[52] U.S. Cl. ..... 52/227; 52/251

[58] Field of Search ..... 52/87, 89, 227, 251, 52/252, 223 R; 14/13, 14, 15, 16.1, 17

[56] References Cited

U.S. PATENT DOCUMENTS

| | | | |
|---|---|---|---|
| 2,373,409 | 4/1945 | Myer | 52/227 X |
| 3,892,096 | 7/1975 | Macchi | 52/227 |
| 3,903,667 | 9/1975 | Zetlin | 52/227 |

*Primary Examiner*—Carl D. Friedman

*Attorney, Agent, or Firm*—Toren, McGeady, Stanger, Goldberg & Kiel

[57] ABSTRACT

In a multi-span bridge support system, the superstructure includes a row of elongated single-span girders arranged end-to-end and supported at their ends on vertical support columns. At least two adjacent girders in a row are provided with fixed bearings at the juxtaposed ends over a common support column. The opposite ends of the girders are mounted on horizontally movable bearings. The location of the fixed bearing and the common support column forms a fixed point. At the fixed point the ends of the girders are notched so that the vertical and horizontal surfaces within the notched region face corresponding surfaces on the top of the support column. A vertical bearing for transmitting horizontal forces extending in the elongated direction of the girders, is located between the top of the support column and the juxtaposed vertical surface within the notched region of the adjacent girders. Tension members, extending perpendicularly to and through the vertical surfaces on which the vertical bearings are located, are fixed to the girders. The tension members extend through the support column and the girders without any bonding action therewith. Further, a horizontal bearing is mounted between the top of the support column and the horizontal extending surfaces within the notched region of the girders.

7 Claims, 6 Drawing Figures

MULTIPLE-SPAN BRIDGE SUPPORT SYSTEM FOR VEHICLES WITH HIGH BRAKING FORCES

BACKGROUND OF THE INVENTION

The present invention is directed to a multi-span bridge support system for vehicles with high braking forces, such as vehicles which are moved at least partially magnetically.

The requirements for an elevated roadway with magnetic rails are different in substantial areas from the requirements for conventional track systems. Where magnetic rails are used, the vehicle and the roadway represent a coupled oscillation system in which determined natural frequencies and stiffnesses are required after extensive examination and testing of the roadway. Accordingly, the superstructure forming the elevated roadway must have great bending stiffness with regard to vertical forces and transversely directed horizontal forces along with a great torsion stiffness. Moreover, the vehicle poses great demand on the alignment and level of the working surfaces in the roadway, that is, the stator plates, the lateral guide rails and the sliding rails. A particular problem results from the starting and the braking forces which are non-uniform relative to the rails and must be safely conducted into the supports as longitudinally directed horizontal forces.

Therefore, the primary object of the present invention is to provide a statically effective, constructionally simple and economical arrangement for the construction and support of the superstructure for a roadway for vehicles with high braking forces, particularly for vehicles moving along magnetic rails.

In accordance with the present invention, the superstructure for a multi-span bridge support system of the type mentioned above includes a row of end-to-end single-span prestressed concrete girders with torsionally stiff cross-sections. The single-span girders are supported on a row of support columns spaced apart in the elongated direction of the girders. The single span girders are provided with upwardly extending girder webs with the roadway slab supported on and being cantilevered outwardly from the girder webs. At least two adjacent single-span girders are supported at adjacent ends so as to be fixed and at the opposite ends so as to be horizontally movable. The opposite ends of the girders are supported on the support columns. The fixed ends of the girders are supported on the common support column and form a fixed point. At the fixed supports there is at least one vertical bearing for transmitting horizontally directed forces acting in the long direction of the girders and positioned in a notched region in the lower part of the girders whereby the notched region has a vertical surface and a horizontal surface juxtaposed to a corresponding vertical surface and horizontal surface on the common support column. Tension members extending perpendicularly to the surfaces supporting the vertical bearings extend through the vertical bearing joints and are secured to the girders on the opposite sides of the joint. At the fixed point there is at least one horizontal bearing for transmitting vertical loads from the notched region of the girder into the top of the support column.

The tension members extend at least approximately on the axis of the vertical bearings, that is, the axis of the horizontal forces being transmitted. Preferably, the tension members are anchored in the transverse cross-girders at the adjacent ends of the girders.

The invention has a substantial advantage in that a pair of vertical bearings are provided at the opposite sides of the support column forming the fixed point. The vertical bearings are secured in the notched region in the lower part of the girders with a vertical bearing on each of the opposite sides of the support column. The vertical bearings are arranged so that the tension members positively pressurize the bearings within the cross-sectional region of the girders. The transverse cross-girders at the ends of the single span girders located above the notched region can be cantilevered outwardly from the cross-section of the elongated girder so that the bearings arranged at the ends of the girders for transmitting vertical loads are arranged so that one-sided lifting of the girders does not present a problem even when high transversely directed horizontal forces are encountered.

The arrangement and position of the vertical and horizontal bearings offers the possibility that the tension members required for the positive pressurizing of the vertical bearings, are continuous along the entire length of the adjacent girders without any bonding action between the tension members and the girders and support column. In other words, the tension members can be anchored at the opposite ends of the girders from the ends located at the fixed point. Since the tension members are continuous at one or both sides of the column support forming the fixed point without any bonding action with the girders, an additional single-span girder can be supported for horizontal displaceability with vertical bearings being arranged between the additional girder and one of the other girders for transmitting the forces produced by the tension members extending through the girders. By post-tensioning or releasing the tension force acting on the tension members, a simple arrangement is afforded for regulating the bending of the girders and for levelling the upper edges of the girders forming the roadway.

To achieve continuous effect of the single-span girders, that is, to produce negative bending moments at the support columns, tension members extending through the joint and the end cross girders at right angles and without any binding action can be provided at the fixed point of the support in the upper region of the girders. These upper tension rods are preferably tensioned against at least one vertical bearing positioned in the upper part of the joint between the girders.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

The superstructure of a bridge support system, embodying the present invention, includes a row of end-to-end single-span pre-stressed concrete girders supported on a row of support columns spaced apart in the elongated direction of the girders. This arrangement can be noted in FIGS. 5 and 6 where the support columns axes A, B and C are assigned to the adjacent ends of a pair of single-span girders I and II in the embodiment of FIG. 5 and support column axes D, E, F and G in FIG. 6 corresponding to the adjacent ends of the single-span girders V, VI and VII. In either embodiment, the support system can extend in both directions.

By using single-span pre-stressed concrete girders there is the advantage that the deformation which must be very closely followed along magnetic rails can be maintained. In this arrangement there are no constraining forces during non-uniform settlement at the base of the arrangement under the support columns and simple assembly and disassembly is possible when the single-span girders are constructed as precast concrete structural components. Moreover, concrete affords a high inherent weight and, accordingly, low eccentricities in the support and foundation, high stiffness or rigidity, and favorable damping characteristics with a resulting resistance to vibrations as well as a reduction in the sound level are provided.

A particularly important feature of the invention is the arrangement of the fixed point bearing effecting the transmission of horizontal forces extending in the long direction of the girders into the support columns. This is shown particularly in FIGS. 1 and 2 or 3 and 4 through the example of the support column axis B of FIG. 5 and E' of FIG. 6.

Figure 2:
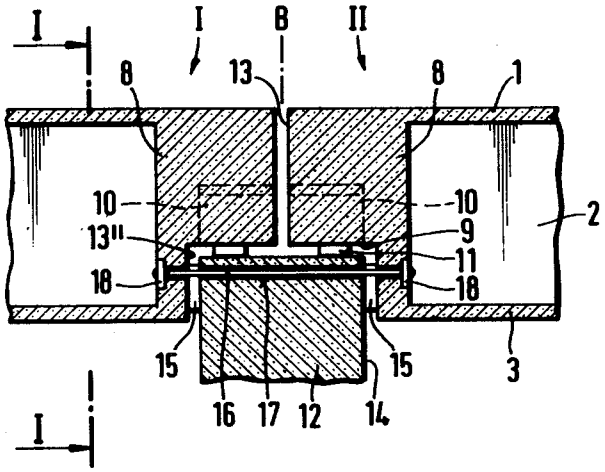
FIG. 2 is a sectional view taken along the line II—II in FIG. 1 in the elongated direction of the girders forming the superstructure.
Figure 1:
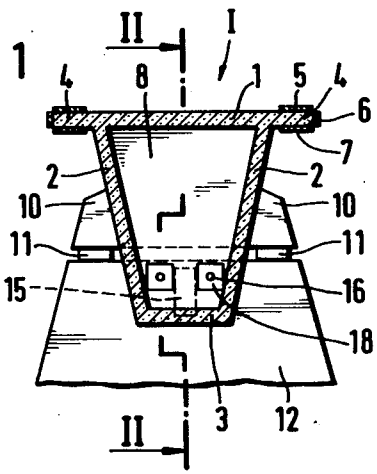
FIG. 1 is a transverse cross-sectional view through one embodiment of a bridge superstructure in accordance with the present invention and taken along the line I—I in FIG. 2.

In the embodiment illustrated in FIGS. 1 and 2, the single-span girders I, II have a hollow, closed, approximately trapezoidal cross-section formed by a pair of girder webs 2 extending downwardly from a roadway slab 1 to a base plate 3. The webs converge inwardly toward one another from the roadway slab to the base plate. The roadway slab 1 projects or cantilevers outwardly at each of the two upper elongated sides of the webs 2. The magnetic suspension rail forming the roadway construction includes a sliding rail 5, a lateral side rail 6 and the stator plate 7 with these rails and plates being located along the edges of the roadway slab cantilevered outwardly from the webs 2. These parts forming the magnetic suspension rail are not part of the invention and, accordingly, are shown only schematically. The cross-sectional arrangement of the girders applies to each of the girders along the length of the bridge.

Even though the hollow or closed trapezoidal cross-section with relatively short cantilevered sections of the roadway slab has a particularly high stiffness with respect to vertical and horizontal forces, as well as to torsion moments, the invention is not limited to this particular cross-sectional shaped, rather other cross-sectional shapes can be used which meet the static and structural requirements.

The single-span girders are pretensioned in accordance with conventional prestressed concrete technology. The prestressing procedure is not a part of the present invention, however, prestressing is necessary to avoid, as much as possible, plastic deformation of the girders. The accuracy of the deformation behavior of the single-span girders is improved by using tension members without relaxation and with the least possible slippage in the anchorages, as well as by the use of an exactly predetermined concrete mixture and by avoiding construction joints or other non-homogeneous conditions within the single-span girders.

As shown in FIG. 2, the single-span girders I and II end in cross girders 8. The cross girders have a notched region 9 in the lower part of the girder and brackets 10 extend laterally outwardly from the opposite sides of the girder. Bearings 11, such as neoprene bearings, are located in the region of the brackets 10 for transmitting vertical forces into the head 12 of the support column. Due to the brackets 10, the bearings 11 are spaced over a relatively large area though the girder has a relatively narrow cross-section.

As shown particularly in FIG. 2, displaying a section in the elongated direction of the girders, at the fixed point or fixed support, the two notched regions 9 in the adjacent ends of the single-span girders I, II enclose the head 12 so that a vertical bearing 15 is located between the vertical surface 13" of the end face 13 of the girders I, or II and the outer vertical surface 14 of the head 12 in juxtaposition to the vertical surface of the notched region. Tension members or rods 16 disposed parallel to the axis of the vertical bearings 15, extending perpendicularly to the surfaces against which the bearings rest, extend through the head 12 in prestressing ducts 17 so that the tension members are movable in the axial direction relative to the support columns. The tension members 16 are anchored in the lower region of the cross girders 8 at the adjacent ends of the single-span girders I, II by means of conventional anchors 18. Tension members 16 extend symmetrically relative to the axis of the vertical bearings 15 so that the bearings 15 can centrally positively pressurize the tension members 16 by applying tensile force.

Figure 5:
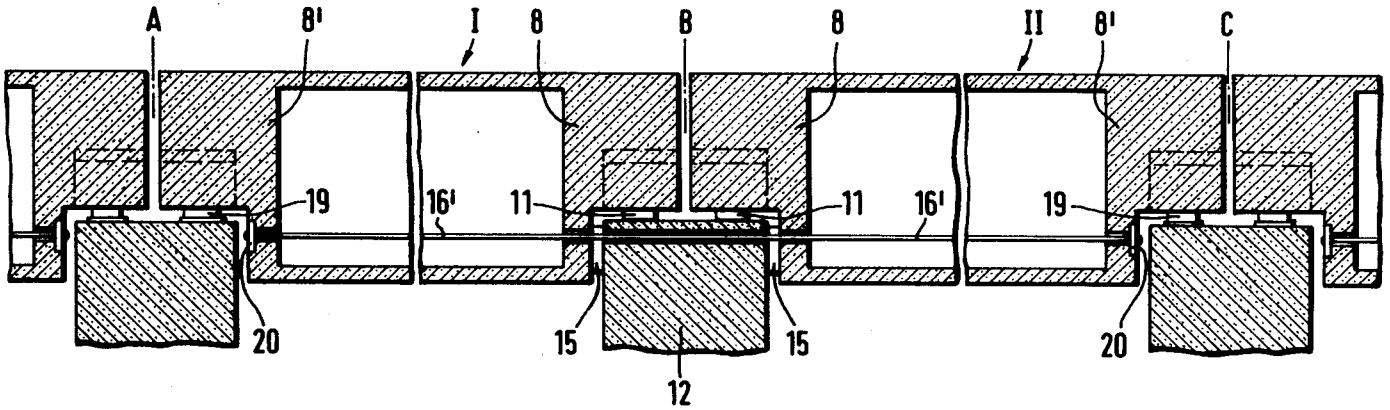
FIG. 5 is a sectional view taken in the elongated direction of the girders showing a bridge superstructure arrangement, embodying the present invention, with two single-span girders having continuous tension members extending therethrough with the tension members being free of any bonding action with the enclosing structures.

In the embodiment displayed in FIG. 5, the support for the two single-span girders I, II corresponds to the previous description relative to the fixed point support in the region of the column axis B with the horizontal bearings 11 and the vertical bearings 15. In addition, horizontally movable bearings 19 are provided at the opposite ends of the girders in the region of the support column axes A, C. The bearings 19 are not described in detail with regard to FIGS. 1 and 2 but are assumed to be used with the arrangements as shown in such figures. In contrast to the arrangement illustrated in FIG. 2, the tie rods 16' in FIG. 5 are guided not only through the head 12 of the support column and the adjacent end cross girders 8 of the single-span girders, but the tension members extend over the length of the single-span girders I and II into and through the end cross girders 8' located at the opposite ends of the single-span girders from the support column axis B. The ends of the tension members 16' are secured by anchors 20 adjacent the support column axis A and the support axis C. As a result, the tension members 16' extend along the entire length of the single-span girders I, II without any composite or bonding action with the girders, that is, they can be post-tensioned or relaxed, respectively, at any time. The control of the bending of the griders and, accordingly, a simple levelling of the upper edges of the roadway, is obtained by adjusting the tension force exerted on the tension members. Such adjustment has a considerable significance in a roadway for magnetic suspension rails.

Furthermore, in the embodiment of FIG. 5, the horizontally movable support for the single-span girders I, II adjacent the support column axes A, C is provided in notched parts at the girder ends in a manner similar to the notched parts of the girders adjacent the support column axis B forming the fixed point of the system, so that no differences appear in the external appearance of the bridge structure. In this embodiment, every second support column along the length of the bridge is designed similar to the construction of the fixed point at the support column axis B whereby only every other support column is required to receive horizontal forces.

Figure 6:
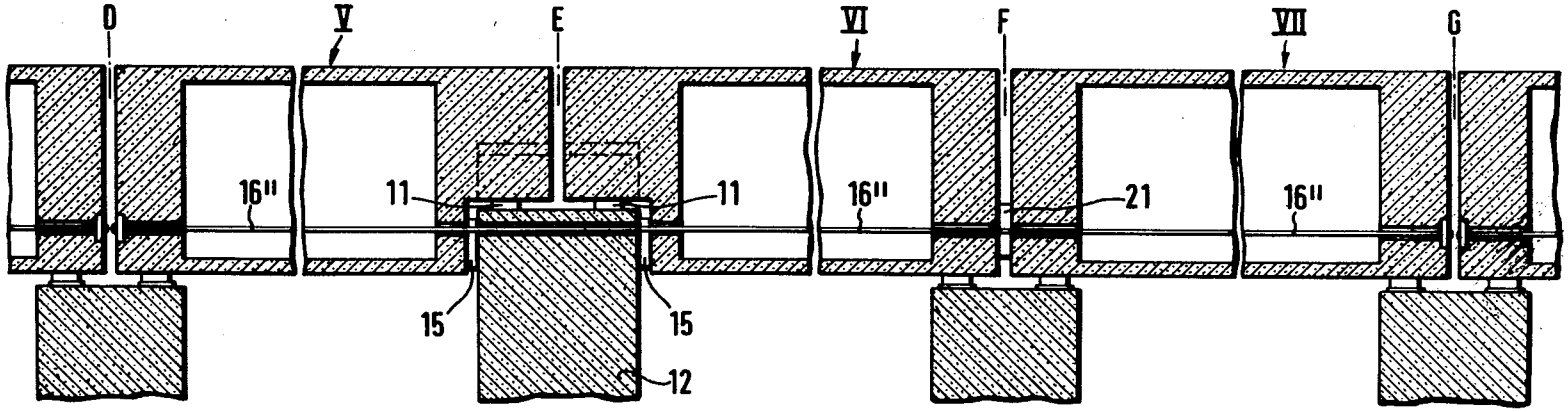
FIG. 6 is a sectional view, similar to FIG. 5 showing a bridge superstructure arrangement, however, the tension members extend through an additional single-span girder without any bonding action therewith on one side of the fixed point formed by the girders and one of the columns.

In FIG. 6 another embodiment is shown with an additional single-span girder VII connected at one end of the pair of single-span girders V and VI with the fixed point support column axis E located between the adjacent ends of the girders V, VI and with the tension members or rods 16' also extending through the single-span girder VII without any bonding action. In other words, the tension members 16'' extend continuously from the support column axis D through the girders V, VI and VII to adjacent the support column axis G. To produce a pressure-proof connection between the single-span girders VI and VII, without impairing their static action as single-span girders, for example, by fixing the end faces, vertical bearings 21 are positioned between the juxtaposed end faces of the single-span girders VI and VII in the region of the support column axis F and the bearings 21 are positively pressurized by the tension members 16'' in a manner similar to that of the vertical bearings 15 in the region of the support column axes B and E, each forming a fixed point. The possibility of connecting one or possibly more single-span girders, as shown in FIG. 6, is provided not only at one side of the girder pair but also at both of the opposite sides or ends.

Figure 4:
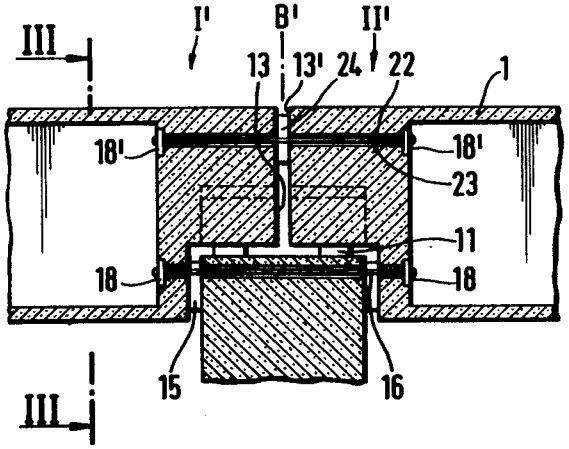
FIG. 4 is a sectional view, similar to FIG. 2, taken along the line IV—IV in FIG. 3.
Figure 3:
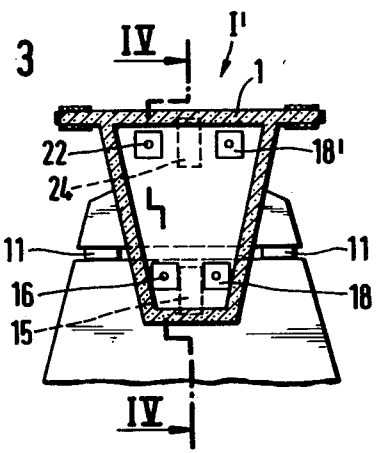
FIG. 3 is a cross-sectional view of another embodiment of the present invention taken along the line III—III in FIG. 4.

In FIGS. 3 and 4 an embodiment is shown at the fixed point support column constructed according to the embodiment in FIGS. 1 and 2 for producing a continuous action between the two single-span girders I' and II'. Tension members 22 are arranged in ducts 23 in the upper region of the ends of the single-span girders for affording the continuous action and the tension members 22 extend through the end cross girders 8 without any bonding action and are secured by suitable anchors 18'. To transmit the pressure force exerted on the ends of the girders by the tension rods 22, a vertical bearing 24 is positioned between the upper parts 13' of the adjacent end surfaces 13 of the girders I', II'.

While specific embodiments of the invention have been shown and described in detail to illustrate the application of the inventive principles, it will be understood that the invention may be embodied otherwise without departing from such principles.

We claim:

1. A multi-span bridge support system for vehicles with high braking forces, such as a roadway for vehicles moved at least partially magnetically, comprising a bridge superstructure including a row of elongated generally horizontal single-span prestressed concrete girders arranged end-to-end and having torsionally stiff cross-sections, a row of generally vertical support columns spaced apart in the elongated direction of said girders, each said girder comprising a lower base plate extending the elongated direction, a pair of laterally spaced webs extending upwardly from said base plate, a roadway slab plate supported on said webs and with the elongated edges of said roadway slab plate being cantilevered laterally outwardly from said webs, a cross girder at each of the opposite ends of said girder, and at least two adjacent said single-span girders in said row being fixed at the adjacent ends thereof and being horizontally movable at the other ends thereof, the fixed ends of said at least two girders being supported at one said support column forming a fixed point, said girders at said fixed point being notched in the lower ends of said cross girder at said support column so that the lower part of each said girder adjacent said support column extends downwardly below the upper end of said support column, the notched parts of said girders at the fixed point at said support column each having a vertically extending first surface and a horizontally extending second surface juxtaposed to a corresponding vertically extending first surface and a horizontally extending second surface on the upper end of said support column, and above the notched parts said girders at the fixed point each having a vertically extending third surface juxtaposed to one another, a vertically arranged bearing positioned between each of said vertically extending first surfaces on said girder and said support column, and horizontally arranged tension members disposed generally perpendicularly to said vertically extending first surface and extending through said vertical bearing with the ends of said tension members extending through said cross-girder into said girders for positively pressurizing said vertical bearings, said tension members being free of any bonding action with said support column and said girders through which said tension members extend, and at least one horizontally extending bearing positioned between the horizontally extending second surfaces on said girder and said support column for transmitting vertically acting loads to said support column.

2. A multi-span bridge support system, as set forth in claim 1, wherein said tension members extend at least approximately through the center of said vertical bearings.

3. A multi-span bridge support system, as set forth in claim 1 or 2, wherein said girders have a hollow cross-section between the cross girders at the ends thereof and said tie members are anchored in said cross girders adjacent said support column at the fixed point.

4. A multi-span bridge support system, as set forth in claim 1 or 2, wherein said tension members are continuous throughout the length of said adjacent girders and are free of any bonding action with said girders and are anchored in said cross girders remote from said support column at the fixed point.

5. A multi-span bridge support system, as set forth in claim 1 or 2, wherein at least one additional said single-span girder is located in end-to-end relation with one of said girders extending from the fixed point, said tension members extending through said girders from said fixed point and through said additional girder for the length thereof and being free of bonding action with said additional girder and said tension members being anchored at one end in the end of said additional girder more remote from the fixed point, and a vertical bearing positioned between said additional bearing and the adjacent one of said girders extending from the fixed point.

6. A multi-span bridge support system, as set forth in claim 1 or 2, wherein additional tension members extend through the adjacent ends of said girders at the fixed point at right angles to the ends of said cross-girders forming the ends of said girders with said additional tension members being located spaced vertically upwardly from said support column at the fixed point.

7. A multi-span bridge support system, as set forth in claim 6, wherein a vertical bearing is located in the upper region between the adjacent ends of said girders at the fixed point above said support column and said additional tension members extend through said additional vertical bearing.

* * * * *

UNITED STATES PATENT AND TRADEMARK OFFICE

CERTIFICATE OF CORRECTION

PATENT NO. : 4,610,117

DATED : September 9, 1986

INVENTOR(S) : Herbert Schambeck, et al

It is certified that error appears in the above-identified patent and that said Letters Patent is hereby corrected as shown below:

On the title page inventors and assignee should read

[75] Inventors: Herbert Schambeck, Frieding/Andechs; Dieter Hilliges, Neuried; Hans Foerst, Aschheim, all of Fed. Rep. of Germany

[73] Assignee: Dyckerhoff & Widmann Aktiengesellschaft, Munich, Fed. Rep. of Germany

Signed and Sealed this

Seventeenth Day of March, 1987

*Attest:*

*Attesting Officer*

DONALD J. QUIGG

*Commissioner of Patents and Trademarks*